US006496992B2

(12) United States Patent
Saparow

(10) Patent No.: US 6,496,992 B2
(45) Date of Patent: Dec. 24, 2002

(54) REVERSIBLE GUSSET BEDCOVERING

(75) Inventor: Herschel Craig Saparow, Marietta, GA (US)

(73) Assignee: Scroll Fabrics, Inc., Smyrna, GA (US)

( * ) Notice: Subject to any disclaimer, the term of this patent is extended or adjusted under 35 U.S.C. 154(b) by 45 days.

(21) Appl. No.: 09/734,313

(22) Filed: Dec. 11, 2000

(65) Prior Publication Data

US 2002/0095727 A1 Jul. 25, 2002

Related U.S. Application Data

(60) Provisional application No. 60/169,877, filed on Dec. 9, 1999.

(51) Int. Cl.[7] ..... A47G 9/00
(52) U.S. Cl. ..... 5/482; 5/499
(58) Field of Search ..... 5/482, 495–502, 5/658

(56) References Cited

U.S. PATENT DOCUMENTS

| | | | | |
|---|---|---|---|---|
| 2,624,893 A | | 1/1953 | Harris | 5/497 |
| 3,013,283 A | | 12/1961 | Steffinich | |
| 3,111,688 A | * | 11/1963 | Barnes | 5/497 |
| 3,127,621 A | | 4/1964 | Gruber | |
| 3,295,150 A | | 1/1967 | Shapiro et al. | |
| 3,381,320 A | | 5/1968 | Mott | |
| 4,301,561 A | | 11/1981 | McLeod | 5/496 |
| 5,029,353 A | | 7/1991 | Kimball et al. | 5/497 |

* cited by examiner

*Primary Examiner*—Alexander Grosz
(74) *Attorney, Agent, or Firm*—Needle & Rosenberg, P.C.

(57) ABSTRACT

A reversible bedcovering assembly, including a main bedcovering having an inward section surrounded by an edge section and at least two side portions attached to the edge section and depending therefrom when installed on a mattress or bed. Each side portion is adjacent at least one other side portion and forms a void therebetween. A gusset insert is provided to substantially fill the void between adjacent side portions, each gusset insert having a top portion and a drape portion attached thereto. Each gusset insert is attached to the main bedcovering adjacent the edge section.

18 Claims, 3 Drawing Sheets

REVERSIBLE GUSSET BEDCOVERING

RELATED U.S. APPLICATION DATA

This application claims priority to U.S. provisional application Serial No. 60/169,877 filed on Dec. 9, 1999. The No. 60/169,877 provisional patent application is herein incorporated by this reference in its entirety.

BACKGROUND OF THE INVENTION

This invention relates to a bedcovering assembly and, more particularly, to a reversible bedcovering assembly. The general purpose of this invention is to provide a bedcovering assembly in a gusset style giving a tailored, fitted style to a bedcovering. In one embodiment, the bedcovering is reversible, such that a single bedcovering can be utilized in either of two configurations, allowing for either the front or back face fabrics of the bedcovering to be exposed to view.

SUMMARY OF THE INVENTION

The present invention, in one aspect, is a bedcovering assembly that includes a main bedcovering having an inward section surrounded by an edge section and at least two side portions. Each side portion has a length, which when installed on a mattress or bed, terminates adjacent the floor upon which the bed or mattress rests, and is attached to and depends from the edge section. Each side portion is adjacent at least one other side portion, and the adjacent side portions form a void therebetween. One or more gusset inserts are included within the bedcovering assembly for each void. Each gusset insert has a top portion and a drape portion attached to the top portion, the length of each gusset insert being substantially equal to the length of the side portions. Each gusset insert is attached to the main bedcovering adjacent the edge section with a fastener assembly, which can be a button or buttons, hook and loop fasteners, snap fittings, buckles or the like. When properly installed, the gusset insert is capable of substantially filling the void formed between adjacent side portions.

In another aspect, the bedcovering assembly is reversible. In such an embodiment, the main bedcovering further includes a first surface and an opposite second surface, each capable of displaying an aesthetically pleasing appearance so that the main bedcovering may be displayed with a selected one of either the first surface or the second surface exposed to view. Further, each gusset insert includes a first surface and an opposite second surface, each surface similarly capable of displaying an aesthetically pleasing appearance so that the gusset inserts may be displayed with a selected one of either the first surface or the second surface exposed to view.

In another aspect, the invention is a method of installing a bedcovering on a mattress that has a mattress surface and a mattress perimeter. According to the invention, the main bedcovering is spread over the mattress and positioned such that the edge section is substantially aligned with the mattress perimeter. A gusset insert is attached to the main bedcovering adjacent the edge section between two adjacent side portions with a fastener assembly and arranged between the two adjacent side portions to substantially fill the void formed between the side portions.

In yet another aspect, the invention is a method of installing a reversible bedcovering on a mattress that has a mattress surface and a mattress perimeter. According to this aspect of the invention, the user selects one of a first surface or an opposite second surface of the main bedcovering to be exposed to view and spreads the main bedcovering over the mattress with the selected surface exposed to view and with the surface not selected facing the mattress. The main bedcovering is positioned on the mattress, and a gusset insert is attached to the main bedcovering on the surface not selected adjacent the edge section between two adjacent side portions with a fastener assembly. The gusset insert is arranged between two adjacent side portions to substantially fill the void formed between the side portions.

Further, the present invention comprises a gusset insert for a bedcovering on a mattress or bed, wherein the bedcovering has an inward section surrounded by an edge section and at least two side portions which depend from the edge section in a generally juxtaposed relationship when the bedcovering is on the mattress or bed. The respective side portions form an opening or void therebetween and the gusset insert is installed by suitable fastening means to substantially fill the opening or void.

DETAILED DESCRIPTION OF THE INVENTION

The present invention is more particularly described in the following examples that are intended as illustrative only since numerous modifications and variations therein will be apparent to those skilled in the art. As used in the specification and in the claims, "a," "an," or "the" can mean one or more, depending upon the context in which it is used. A preferred embodiment is now described with reference to the figures, in which like numbers indicate like parts throughout the figures.

Figure 1:
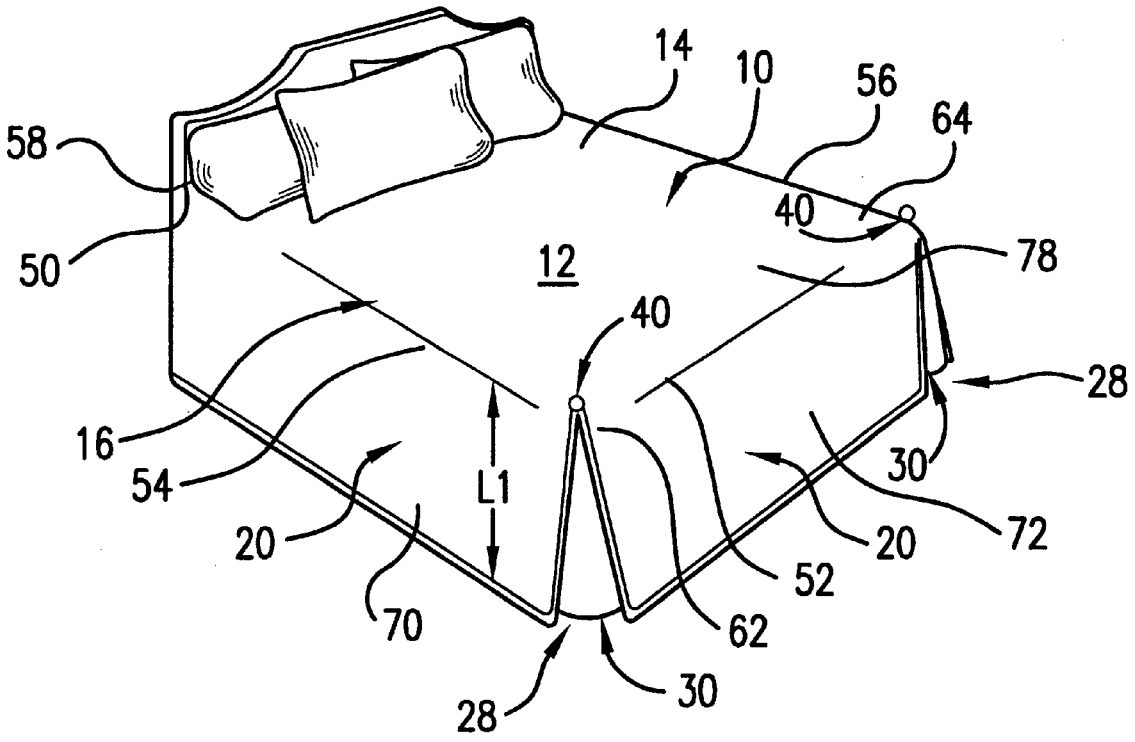
FIG. 1 is a perspective view showing the reversible gusset style bedcovering of the present invention.

Referring to FIG. 1, a first embodiment of the present invention comprises a bedcovering assembly 10 that includes a main bedcovering 12 having an inward section 14 surrounded by an edge section 16 and two or more side portions 20. Each side portion 20 has a length L1 and is attached to and depends from the edge section 16 when the main bedcovering 12 is placed in overlying relationship with the surface of a mattress or bed. Each side portion 20 is adjacent at least one other side portion 20, and the adjacent side portions 20 form a void 28 therebetween. At least one gusset insert 30 is included within the bedcovering assembly 10.

Figure 2:
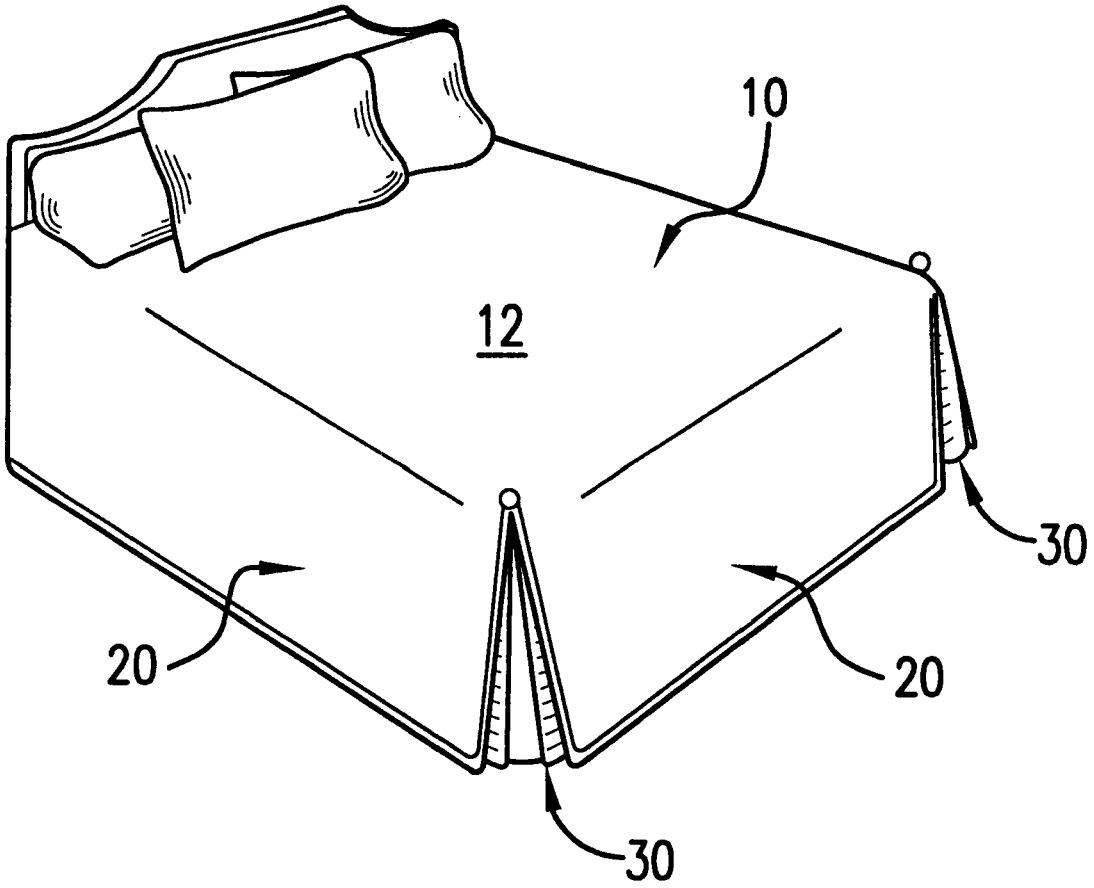
FIG. 2 is a perspective view showing the reversible kickpleat insert of the present invention.
Figure 3:
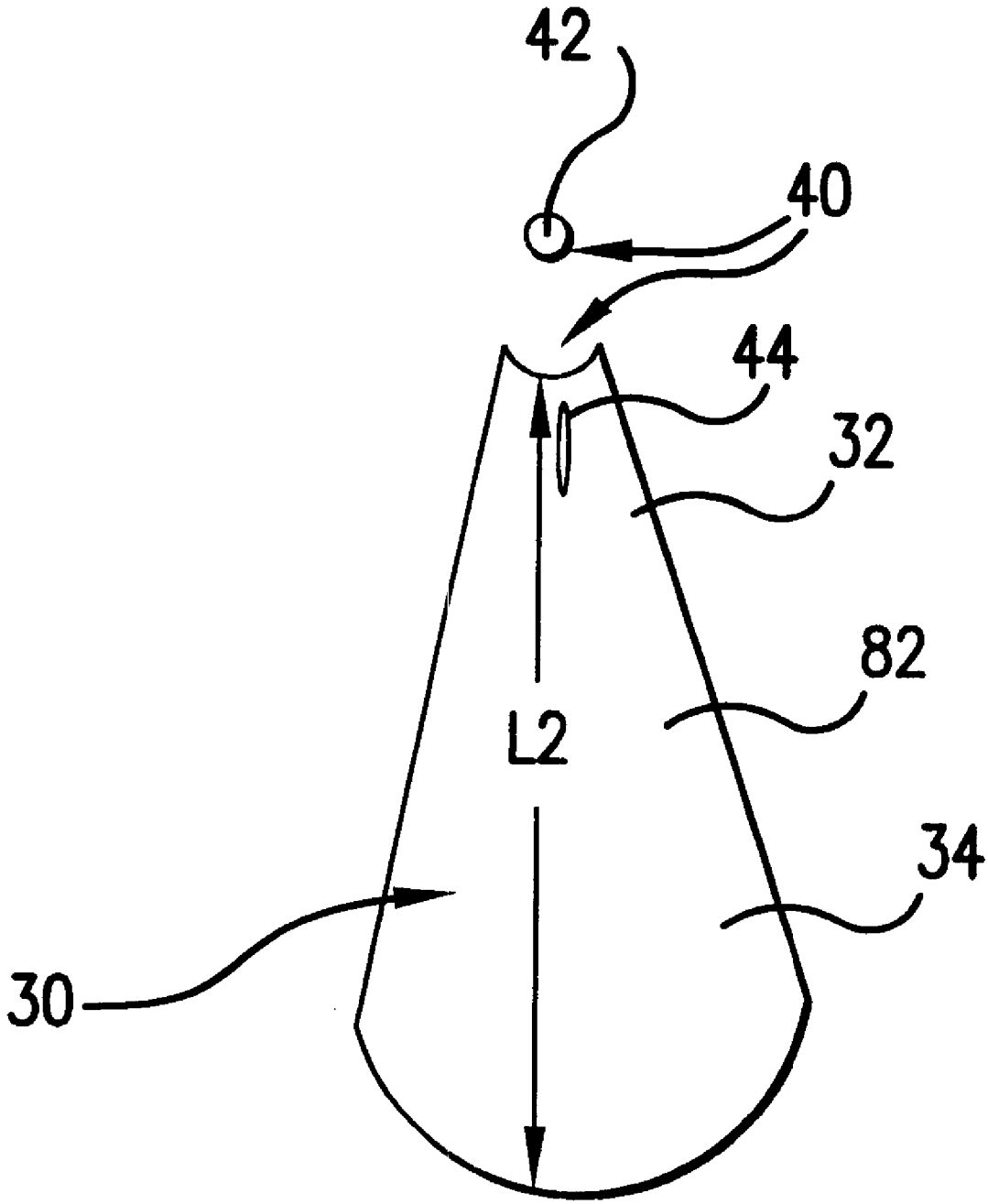
FIG. 3 is a perspective view of an embodiment of the gusset insert of the present invention, exploded away from the respective fastener button.

Referring to FIG. 3, each gusset insert 30 has a top portion 32 and a drape portion 34 attached to with the top portion 32, the length L2 of each gusset insert 30 being substantially equal to the length L1 of the side portions 20 when the bedcovering assembly 10 is installed on a mattress or bed. In the embodiments shown in FIGS. 1 and 2, the lengths L1 and L2 are sufficient to substantially extend the distance between the mattress surface and the floor upon which the bed or mattress rests.

Referring again to FIG. 3, the top portion 32 of the gusset insert 30 may be integrally formed with the drape portion 34, or may be permanently or removably attached to the drape portion 34. Each gusset insert 30 is attached to the main bedcovering 12 adjacent the edge section 16 with a fastener assembly 40. When properly installed, the gusset insert 30 is capable of substantially filling the void 28 formed between adjacent side portions 20.

The bedcovering assembly 10 may be adapted to cover any size or shape mattress, including round, square, rectangular, or any other geometric shape. Because rectangular mattresses appear to be most common, however, the description and the figures of the drawings are focused on such a mattress for the sake of simplicity.

In such an embodiment, the edge section 16 of the main bedcovering 12 includes a head edge 50, an opposite foot edge 52, a first side edge 54 and an opposite second side edge 56. A first top corner 58 and a second top corner (not shown) are formed at the points of intersection between the head edge 50 and the first side edge 54, and the head edge 50 and the second side edge 56, respectively. First and second bottom corners 62, 64 are formed at the points of intersection between the foot edge 52 and the first side edge 54, and the foot edge 52 and the second side edge 56, respectively.

In such an embodiment, the main bedcovering 12 has three rectangular side portions, a first side portion 70 attached to and depending from the first side edge 54, a second side portion (not shown) attached to and depending from the second side edge 56, and a third side portion 72 attached to and depending from the foot edge 52. The first side portion 70 and the third side portion 72 substantially meet adjacent the first bottom corner 62 and form a first void 28 therebetween, and wherein the second side portion and the third side portion 72 substantially meet adjacent the second bottom corner 64 and form a second void 28 therebetween.

The gusset inserts 30 provided as part of the bedcovering assembly 10 may be of various configurations and designs according to the invention. One gusset insert 30 is provided to fill the void 28 created at the junction of adjacent side portions 20 of the main bedcovering 12. To provide an aesthetically pleasing and attractive appearance, a single gusset insert 30 is attached to the main bedcovering adjacent the edge section 16 at or near the location where two adjacent side portions 20 on the main bedcovering 12 meet.

The gusset inserts 30 provide an attractive appearance by filling the void 28 between neighboring side portions 20, and thus obscuring any onlooker's view of sheets, blankets, mattresses, box springs, bed frames or other components of the underlying bed or linens (not shown). The gusset inserts 30 may be manufactured of any suitable material desired by the user. In one embodiment, however, the gusset insert 30 is manufactured of fabric. Similarly, the gusset inserts 30 may be manufactured of the same or similar material, and may be provided with the same or similar appearance, as the main bedcovering 12. Or, according to the preference of the user, the main bedcovering 12 and gusset inserts 30 may be made of different materials or exhibit different appearances from one another. It should be appreciated that the selection of appearance of the main bedcovering 12 and the gusset inserts 30 is controlled by the discretion of the user, and should not be construed as a limitation on the scope of the invention or the appended claims.

In the embodiment set forth in FIG. 1, two gusset inserts 30 are provided, one gusset insert 30 located at the first bottom corner 62 and filling the void 28 between the first side portion 70 and the third side portion 72. The other gusset insert 30 in this embodiment is located at the second bottom corner 64 and fills the void 28 between the second side portion and the third side portion 72.

Gusset inserts 30 may be provided in any of a plurality of styles. For example, FIG. 1 shows a gusset insert 30 that is tailored to exhibit a smooth appearance when installed in the bedcovering assembly 10. FIG. 2 shows a kickpleated gusset insert 30 having a different aesthetic appearance including one or more pleats. Other styles, such as shirred or box-pleated gusset inserts (not shown) are contemplated and are considered to be within the scope of the invention.

Other not shown embodiments of the bedcovering assembly 10 having greater or fewer than two gusset inserts 30 are also contemplated within the scope of the invention. For example, mattresses having irregular shapes, such as ovals, circles, triangles, pentagons or other geometrical shapes, may be fitted with a bedcovering assembly 10 according to the invention. Such mattresses may require greater or fewer than two gusset inserts 30. A circular mattress (not shown), for example, may require five or more gusset inserts to fill voids created between six or more side portions of the main bedcovering. The number of discrete side portions required to create a bedcovering with the desired fit on the mattress is within the discretion of the user. Typically, a bedcovering assembly 10 designed to fit a mattress having a polygonal shape will best fit the mattress if a discrete side portion is provided along each of the plurality of edges of the main bedcovering intended to correspond to a discrete sides of the polygonal mattress. In such a design, each corner of the polygonal mattress will correspond in location to a gusset insert 30, providing a satisfactory fit between the bedcovering assembly and the mattress.

In one embodiment, the bedcovering assembly 10 of the present invention is reversible, such that the main bedcovering 12 may be installed on a mattress with either its first surface 78 or its opposite second surface (not shown) exposed to view. The reversible bedcovering assembly 12 may be provided with different with different colors or patterns of face fabric on the first and second surfaces of the main bedcovering, such that the user may choose which face fabric is exposed to view according to aesthetic preference. Also, instead of immediately washing a soiled bedcovering assembly 10, the user may choose to simply reverse the bedcovering assembly 10 such that the soiled surface is hidden and the other surface is exposed to view.

In embodiments wherein the bedcovering assembly 10 is reversible, a reversible gusset insert 30 may also be provided, in which the gusset insert 30 includes a first surface 82 and an opposite second surface (not shown), each capable of displaying an aesthetically pleasing appearance. In one embodiment, the first surface 82 of the gusset insert 30 has the same appearance as the first surface 78 of the main bedcovering 12, i.e., the respective first surfaces of the main bedcovering and gusset insert "match," decoratively speaking. The scope of the invention, however, is not intended to be limited to matching components of the bedcovering assembly 10. According to the invention, any selection of colors, materials, patterns, arrangements or other aesthetic choices are left to the preference of the user.

In any embodiment of the bedcovering assembly 10, whether reversible or not, the outermost perimeter of the main bedcovering 12 may be finished with a hem (not shown) using binding tape (not shown). The binding tape may also have a welt cord (not shown) at the hem.

Referring to FIG. 1, each gusset insert 30 is attached to the main bedcovering 12 by a fastener assembly 40. The fastener assembly 40 includes a first fastener 42 affixed to a selected one of the edge section 16 or the gusset insert 30 and a corresponding second fastener 44 on the other of the edge portion 16 or gusset insert 30 which is in attaching relationship to the first fastener 42. The fastener assembly 40 thus attaches a gusset insert 30 to the main bedcovering 12 adjacent the edge section 16 such that the gusset insert 30 substantially fills the void 28 formed between adjacent side portions 20.

In the embodiment shown in FIG. 3, the first fastener 42 is a button attached to the main bedcovering 12 adjacent the edge section 14. The button engages the second fastener 44, a corresponding buttonhole passing through the top portion 32 of a selected gusset insert 30. Thus, in this embodiment, the gusset insert 30 is removably attached to the main bedcovering 12.

As further shown in FIG. 1, in the illustrated embodiment, the fastener assembly 40 may be adapted to accommodate a reversible bedcovering assembly 10. The fastener assembly 40 shown in FIG. 1 includes first fastener 42 including a pair of buttons. A first button is disposed adjacent the edge section 14 of the main bedcovering 12 on the first surface 78 of the main bedcovering 12. The first button may be provided with an appearance or finish similar or identical to the appearance or finish of the first surface 78 of the main bedcovering 12. For example, if the first surface 78 of the main bedcovering 12 is provided with a face fabric, the first button may be upholstered with the same face fabric. Alternatively, a decorative button may be utilized according to the preference of the user.

A second button (not shown) is disposed on the second surface (not shown) of the main bedcovering 12, opposite the location of the first button, and may be similarly provided with an appearance that matches the appearance of the second surface of the main bedcovering 12. In the illustrated embodiment, in which the first surface 78 of the main bedcovering 12 is exposed to view, the gusset insert 30 is attached to the second button (not shown). According to this embodiment, the fastener assembly 40 is primarily hidden from view, with the exception of the decorative first button, improving the aesthetic appearance of the bedcovering assembly.

The location of the first fastener 42 and the corresponding second fastener 44 may also be reversed. That is, the first fastener 42 may appear on the gusset insert 30 and the second fastener 44 may be located at the proper location on the main bedcovering 12.

It will be readily appreciated that any of a plurality of different fastener assemblies 40 may be selected to attach the gusset insert 30 to the main bedcovering 12. For example, as an alternative to the buttons discussed above, hook and loop fasteners, snaps, rivets, magnets, clips, buckles or any other means of positively attaching the gusset insert 30 to the main bedcovering 12 may be used according to the invention.

Additionally, in other embodiments, the gusset insert 30 may be permanently attached to the main bedcovering 12. Such permanent attachment may be accomplished by any of a plurality of conventional means, such as by stitching, adhesive, binding, or other means.

Though an embodiment of the fastener assembly 40 having a first fastener 42 with two discrete buttons is disclosed above, other embodiments are contemplated within the scope of the invention in which two discrete buttons are unnecessary. For example, a substantially hidden fastener assembly 40 may be provided such that the first fastener 42 is provided in a recess or pocket (not shown) adjacent the edge section 14, between the first and second surfaces of the main bedcovering 12. In one embodiment, a button (not shown) may be provided in such a recess, such that the button would be hidden from view in either of the reversible installation positions of the main bedcovering 12. Using the example of the button/buttonhole embodiment of the fastener assembly 40, the gusset insert 30 is installed by inserting the top portion 32 of the gusset insert 30 into the recess or pocket, engaging the button with the buttonhole on the top portion 32 of the gusset insert 30, and arranging the gusset insert 30 to fill the void between the adjacent side portions. It is further contemplated that any of the above-disclosed alternative embodiments of the fastener assembly 40 may be adapted in the fashion set forth in this paragraph according to the invention.

Also according to the invention, a method of installing a bedcovering assembly 10 as set forth above is disclosed. According to the method of the invention, a bedcovering assembly 10 is installed on a mattress having a mattress surface and a mattress perimeter. The user spreads the main bedcovering 12 over the mattress. As set forth above, the main bedcovering 12 includes an inward section 14, an edge section 16 surrounding the inward section 14, and two or more side portions 20 having a length L1, each side portion 20 attached to the edge section 16 and depending therefrom, each side portion 20 adjacent at least one other side portion 20 and forming a void 28 therebetween.

The user positions the main bedcovering 12 such that the inward section 14 substantially overlies the mattress surface and the edge section 16 is substantially aligned with the mattress perimeter. Referring to FIG. 1, for example, the mattress shape is rectangular and the mattress perimeter corresponds substantially to the shape and size of the edge section 16 of the main bedcovering 12. According to the positioning step, the user places the main bedcovering 12 on the mattress and ensures that the edge section 16 is positioned substantially in alignment with the mattress perimeter.

A gusset insert 30 is attached to the main bedcovering 12 adjacent the edge section 16 between two adjacent side portions 20 with a fastener assembly 40, and arranged between two adjacent side portions 20 to substantially fill the void 28 formed between the side portions 20.

It will be appreciated that the step of attaching the gusset inserts 30 to the main bedcovering 12 may be performed before or after the step of positioning the main bedcovering 12 on the mattress surface according to the preference of the user, without departing from the scope of the method of the invention.

For bedcovering assemblies 10 of the reversible type, a similar method of installation is also disclosed according to the invention. The user selects either the first surface 78 or the opposite second surface (not shown) of the main bedcovering 12 to be exposed to view, then installs the main bedcovering 12 and gusset inserts 30 over the mattress as set forth above.

It is also contemplated that a gusset insert 30 may be sold separately from the main bedcovering 12. That could provide the user with a plurality of decorative choices for matching a gusset insert 30 to the main bedcovering 12.

The above described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. A bedcovering assembly, comprising:

a. a main bedcovering comprising an inward section surrounded by an edge section and at least two side portions having a length, each side portion attached to the edge section adjacent at least one other side portion and forming a void therebetween;

b. at least one gusset insert having a top portion and a drape portion attached thereto, the gusset insert having a length substantially equal to the length of the side portions; and c. at least one fastener assembly, comprising a first fastener on a selected one of the edge section or the gusset insert and a corresponding second fastener on the other of the edge portion or gusset insert which is in attaching relationship to the first fastener, so as to attach a gusset insert to the main bedcovering adjacent the edge section and so as to substantially fill the void formed between adjacent side portions.

2. The assembly of claim 1, wherein the first fastener comprises a button attached to the main bedcovering adjacent the edge section and the second fastener is a buttonhole in registration with the button and passing through the top portion of a selected gusset insert.

3. The assembly of claim 1, wherein the edge section of the main bedcovering is substantially rectangular in shape.

4. The assembly of claim 3, wherein the edge section comprises a head edge, an opposite foot edge, a first side edge and an opposite second side edge, the edge section further comprising corners formed at points of intersection between the edges, first and second top corners being formed at points of intersection between the head edge and the first side edge, and the head edge and the second side edge, respectively, and first and second bottom corners being formed at points of intersection between the foot edge and the first side edge, and the foot edge and the second side edge, respectively.

5. The assembly of claim 4, the main bedcovering further comprising three rectangular side portions, a first side portion attached to the first side edge, a second side portion attached to the second side edge, and a third side portion attached to the foot edge.

6. The assembly of claim 5, wherein the first side portion and the third side portion substantially meet adjacent the first bottom corner and form a first void therebetween, and wherein the second side portion and the third side portion substantially meet adjacent the second bottom corner and form a second void therebetween.

7. The assembly of claim 6, wherein two gusset inserts are provided, a first gusset insert attached to the main bedcovering adjacent the first bottom corner and substantially covering the first void, and a second gusset insert of the edge section attached to the main bedcovering adjacent the second bottom corner and substantially covering the second void.

8. The assembly of claim 1, wherein the gusset insert is removably attached to the main bedcovering.

9. The assembly of claim 1, wherein the main bedcovering includes a first surface and an opposite second surface, each capable of displaying an aesthetically pleasing appearance.

10. The assembly of claim 9, wherein the first fastener comprises two buttons, one button attached to the first surface of the main bedcovering adjacent the edge section and the other button attached to the second surface of the main bedcovering adjacent the edge section and the second fastener is a buttonhole defined by the top portion of a selected gusset insert.

11. The assembly of claim 10, wherein the bedcovering assembly further comprises two fastener assemblies, the first fastener of the first fastener assembly being attached to the main bedcovering adjacent the first bottom corner, and the first fastener of the second fastener assembly being attached to the main bedcovering adjacent the second bottom corner.

12. The assembly of claim 1, wherein the gusset insert includes a first surface and an opposite second surface, each capable of displaying an aesthetically pleasing appearance.

13. The assembly of claim 1, wherein the gusset insert is tailored.

14. The assembly of claim 1, wherein the gusset insert is kickpleated.

15. A bedcovering assembly, comprising:

a. a mattress, having a mattress surface with a rectangular shape and a mattress perimeter;

b. a main bedcovering comprising an inward section of substantially the same shape as the mattress surface that substantially overlies the mattress surface, an edge section surrounding the inward section, and at least two side portions having a length, each side portion attached to the edge section and depending therefrom when the inward section is in overlying relationship to the top surface, and each side portion adjacent at least one other side portion and forming a void therebetween;

c. at least one gusset insert having a top portion and a drape portion attached thereto, the gusset insert having a length substantially equal to the length of the side portions; and d. at least one fastener assembly, comprising a first fastener on a selected one of the edge section or the gusset insert and a corresponding second fastener on the other of the edge portion or gusset insert which is in attaching relationship to the first fastener, so as to attach a gusset insert to the main bedcovering adjacent the edge section and so as to substantially fill the void formed between adjacent side portions.

16. A reversible bedcovering assembly, comprising:

a. a main bedcovering comprising an inward section surrounded by an edge section and at least two side portions having a length, each side portion attached to the edge section adjacent at least one other side portion and forming a void therebetween, the main bedcovering further comprising a first surface and an opposite second surface, each capable of displaying an aesthetically pleasing appearance so that the main bedcovering may be displayed with a selected one of either the first surface or the second surface exposed to view;

b. at least one gusset insert having a top portion, a drape portion attached thereto, a length substantially equal to the length of the side portions, and a first surface and an opposite second surface, each surface capable of displaying an aesthetically pleasing appearance so that the gusset insert may be displayed with a selected one of either the first surface or the second surface exposed to view; and c. at least one fastener assembly, comprising a first fastener on a selected one of the edge section or the gusset insert and a corresponding second fastener on the other of the edge portion or gusset insert which is in attaching relationship to the first fastener, so as to attach a gusset insert to the main bedcovering adjacent the edge section and so as to substantially fill the void formed between adjacent side portions.

17. A method of installing a bedcovering assembly on a mattress having a mattress surface and a mattress perimeter, comprising the steps of:

a. spreading a main bedcovering over the mattress, the main bedcovering comprising an inward section, an edge section surrounding the inward section, and at least two side portions having a length, each side portion attached to the edge section and depending therefrom, each side portion adjacent at least one other side portion and forming a void therebetween;

b. positioning the main bedcovering such that the inward section substantially overlies the mattress surface and such that edge section is substantially aligned with the mattress perimeter;

c. attaching a gusset insert to the main bedcovering adjacent the edge section between two adjacent side portions with a fastener assembly; and d. arranging the gusset insert to substantially fill the void formed between the side portions.

18. A method of installing a reversible bedcovering assembly on a mattress having a mattress surface and a mattress perimeter, comprising the steps of:

a. selecting one of a first surface or an opposite second surface of the main bedcovering to be exposed to view;

b. spreading a main bedcovering over the mattress with the selected surface exposed to view and with the surface not selected facing the mattress, the main bedcovering comprising an inward section, an edge section surrounding the inward section, and at least two side portions having a length, each side portion attached to the edge section and depending therefrom, each side portion adjacent at least one other side portion and forming a void therebetween;

c. positioning the main bedcovering such that the inward section substantially overlies the mattress surface and such that edge section is substantially aligned with the mattress perimeter;

d. attaching a gusset insert to the main bedcovering on the surface not selected adjacent the edge section between two adjacent side portions with a fastener assembly; and e. arranging the gusset insert to substantially fill the void formed between the side portions.

* * * * *